United States Patent [19]

Klaeger

[11] 3,986,355

[45] Oct. 19, 1976

[54] WELL HEAD GAS COUNTER BALANCED AND OPERATED ACTUATOR FOR OIL WELL PUMPS

[76] Inventor: Joseph H. Klaeger, 1308 Shady Lane, Hondo, Tex. 78861

[22] Filed: Nov. 12, 1975

[21] Appl. No.: 631,102

Related U.S. Application Data

[63] Continuation-in-part of Ser. No. 497,695, Aug. 15, 1974, Pat. No. 3,932,990, and a continuation-in-part of Ser. No. 421,844, Feb. 5, 1973, Pat. No. 3,933,175.

[52] U.S. Cl. ..... 60/369; 60/370; 60/372; 91/303; 91/304

[51] Int. Cl.[2] ..... F15B 1/00; F15B 13/042

[58] Field of Search ..... 60/369, 370, 371, 372, 60/407, 412, 456; 91/303, 304

[56] References Cited

UNITED STATES PATENTS

| | | | |
|---|---|---|---|
| 2,560,285 | 7/1951 | Habenicht | 91/304 X |
| 2,972,863 | 2/1961 | Hyde | 60/372 |
| 3,412,646 | 11/1968 | Johnston | 91/290 |
| 3,643,432 | 2/1972 | Klaeger | 60/412 |
| 3,801,230 | 4/1974 | Brown | 60/472 X |

*Primary Examiner*—Edgar W. Geoghegan
*Attorney, Agent, or Firm*—Willard J. Hodges, Jr.

[57] ABSTRACT

A pumping device secured to a well head adapted to be counter balanced and operated by well head gas pressure. The pumping cylinder and the counter balance cylinder are positioned on a prolonged axis and employ a common polished piston rod operably mounted on the axis of the cylinders. The counter balance piston is pressurized through a volume tank receiving gas through a pressure regulator from the well head. The pumping piston is powered up and down by direct pressure from the well head gas. The flow of gas to and from the pumping cylinder is controlled by a floating piston five-way valve admitting directly well head gas to drive the piston and exhausting the gas to the gas flow delivery line. Snifter valves control the floating piston five-way valve and pressure regulators positioned between the well head and the gas flow delivery line maintain operable differential pressure in the system.

6 Claims, 9 Drawing Figures

FIG. 7
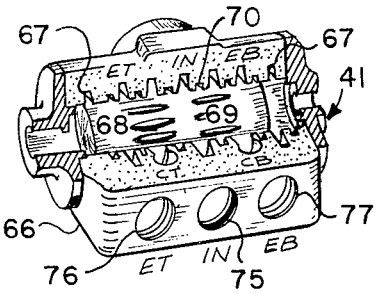
FIG. 8
FIG. 9
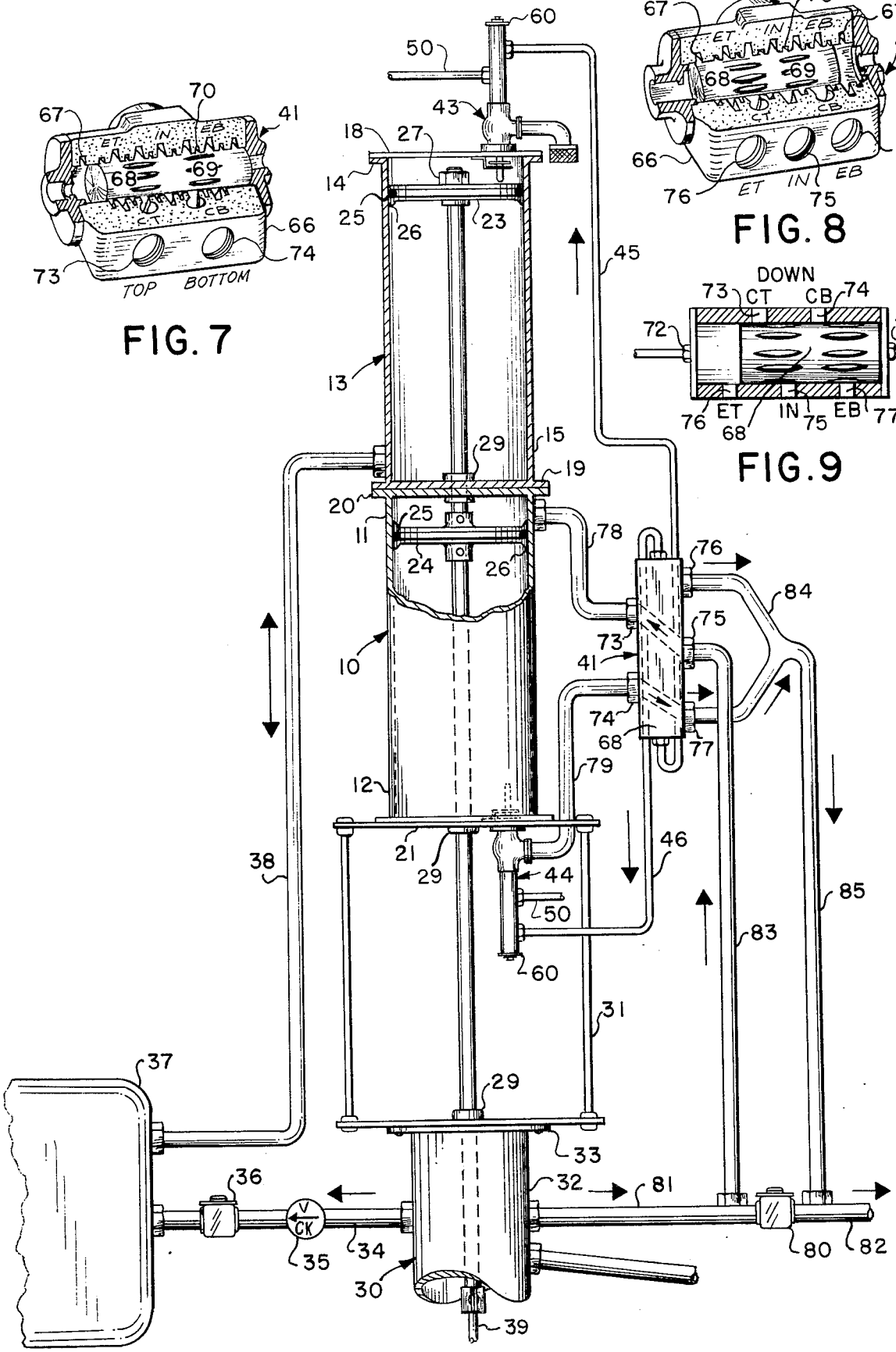
FIG. 6

WELL HEAD GAS COUNTER BALANCED AND OPERATED ACTUATOR FOR OIL WELL PUMPS

CROSS REFERENCE TO RELATED APPLICATIONS

This application is continuation in part of application Ser. No. 421,844 filed Feb. 5, 1973, U.S. Pat. No. 3,933,175 Joseph H. Klaeger, entitled "Snifter Valve Useful in Control Means for a Piston in a Cylinder" and application Ser. No. 497,695 filed Aug. 15, 1974, U.S. Pat. No. 3,932,990 Joseph H. Klaeger, entitled "Closed Loop Booster System Pneumatic Actuator for Oil Wells." This invention is an improvement and a special adaptation of your applicant's U.S. Pat. No. 3,643,432 issued Feb. 22, 1972, and U.S. Pat. No. 3,782,247 issued Jan. 1, 1974.

BACKGROUND OF THE INVENTION

1. Field of the Invention

This invention pertains to a pneumatic actuator for oil well pumps. The device is counter balanced and operated by the pneumatic pressure of the well head gas.

2. Description of Prior Art

Extensive efforts have been devoted to the development of devices which are gas, steam and air driven for actuation of oil well sucker rods driving down hole pumps. Devices currently in use comprise your applicant's patented devices and applications referred to above. Several prior patents are cited as references in applicant's issued patents. Related to this particular application is U.S. Pat. No. 3,801,230, to R. Brown, in that Brown does employ well head gas as a pressure source and his device is counter balanced. This is a highly developed and crowded art, not compatible with being briefly summarized in detail.

SUMMARY OF THE INVENTION

This invention pertains to a pumping device secured to a well head including a counter balance cylinder mounted in elongation of a pumping cylinder. Each cylinder has a piston which is operably secured to a common polished piston rod. The counter balance cylinder is operably pressurized by well head gas through a pressure regulator admitting gas into a counter balance volume tank operating the counter balance piston. The pumping piston is operated by direct pressure of well head gas on the up and down stroke. Opposite sides of the pumping piston are alternately driven on the up and down stroke by directly admitting well head gas to alternate sides of the power piston and exhausting the gas through an exhaust manifold to the gas flow delivery line through floating piston five-way valve. The floating piston five-way valve is of the bleeder valve type having internal passages to place the floating piston under constant load which is alternately controlled by a top snifter valve in the top of the counter balance cylinder and a bottom snifter valve in the bottom of the pumping cylinder. A pressure regulator is operably positioned in the system between the well head gas power line and the gas delivery line. The purpose of this pressure regulator is to maintain a differential pressure between the well head gas admitted to the power line and the static pressure in the gas delivery line of sufficient magnitude to operate the system.

For a detailed description of the preferred embodiment, reference is made to the attached drawings wherein identical reference numerals will be used to refer to identical or equivalent components throughout the various views and the following detailed description.

BRIEF DESCRIPTION OF THE DRAWINGS

FIG. 6 is a plan view of the device mounted on a well head partially fragmented and partially schematic at the initiation of the down stroke.

FIG. 7 is a plan view partially sectional of the floating piston five-way valve viewed from the cylinder port side.

FIG. 8 is a plan view partially sectional of the floating piston five-way valve viewed from the inlet and exhaust side of the device.

FIG. 9 is a schematic view of the floating piston five-way control valve principally illustrating the floating piston at the initiation of the down stroke.

DETAILED DESCRIPTION OF THE PREFERRED EMBODIMENT

Figures 1, 2, 3, 4, 5:
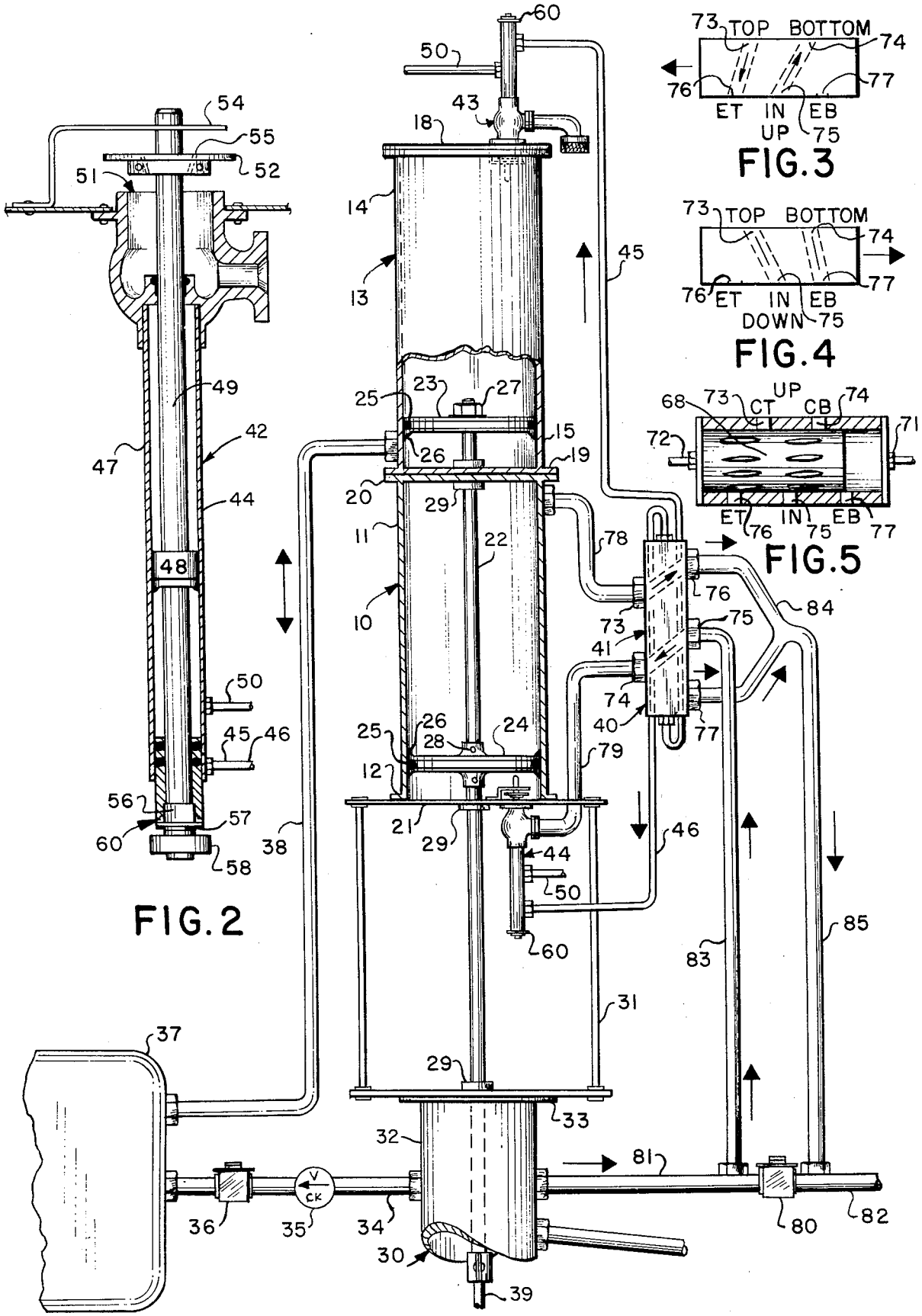
FIG. 1 is a plan view of the device partially schematic and fragmented illustrated at the beginning of the up stroke.
FIG. 2 is a sectional view of the snifter control valves utilized in the top of the counter balance cylinder and the bottom of the pumping cylinder to control the floating piston five-way valve.
FIG. 3 is a schematic illustration of the floating piston five-way control valve at the initiation of the up stroke.
FIG. 4 is a schematic illustration of the floating piston five-way valve at the initiation of the down stroke.
FIG. 5 is a fragmented view of the floating piston five-way valve principally illustrating the floating piston at the initiation of the up stroke.

For a full understanding of the various components of the device of this invention further detail may be obtained from a reading of your applicant's U.S. Pat. No. 3,643,432 and U.S. Pat. No. 3,782,247. The floating piston five-way valve is a commercially available item distributed by the Womack Machine Company of Dallas, Texas, under the tradename of AAA Products, and an example of a similar valve which has been patented is U.S. Pat. No. 2,729,243 to Olson. The details of the construction of the snifter valves incorporated in the preferred embodiment are described in detail in applicant's U.S. application Ser. No. 421,844 filed Dec. 5, 1973, now U.S. Pat. No. 3,933,175. Also, further details of the construction of various components appear in applicant's U.S. application Ser. No. 497,695 filed Aug. 15, 1974, now U.S. Pat. No. 3,932,990.

For a description of the construction and arrangement of the device reference is made to the drawings and particularly FIGS. 1 and 6. The preferred embodiment incorporates a pumping cylinder 10 which may be constructed of mild steel tubular stock having an inside diameter of 10 inches. The pumping cylinder has a pumping cylinder top 11 and a pumping cylinder bottom 12. The preferred embodiment illustrated employs a counter balance cylinder 13 of similar construction mounted in elongation of pumping cylinder 10. The counter balance cylinder 13 has a counter balance cylinder top 14 and a counter balance cylinder bottom 15. In the attached drawings the counter balance cylinder 13 and the pumping cylinder 10 are illustrated as having similar interior diameters. An obvious modification would be to employ a counter balance cylinder of smaller diameter than the pumping cylinder 10. Enclosing the ends of counter balance cylinder 13 are counter balance cylinder head top 18 and counter balance cylinder head bottom 19. In a similar fashion, enclosing pumping cylinder 10 is a pumping cylinder head top 20 and pumping cylinder head bottom 21. Operably sealed and movably mounted on the common axis of the pumping cylinder 10 and counter balance cylinder 13 is axial piston rod 22. Mounted in the respective cylinders 10, 13 are counter balance piston 23 and power piston 24. These respective pistons 23 and 24 should be equipped with piston rings 25 or pressure cups 26. Counter balance piston 23 is attached to the axial piston rod 22 by means of a counter balance piston securing means 27. This means may consist of threadably securing with nuts, pinning, or other securing means. Power piston 24 is similarly secured to the axial piston rod 22 by conventional power piston securing means 28. To prevent the direct flow of gas adjacent the axial piston rod 22 at the axial openings into the various cylinders axial piston rod seals 29 are employed. An identical seal is employed at the opening into the well head 30. Well head mounting means 31 for the device is securely attached to the well head casing 32 which is mounted on well head cap 33 which encloses the well head 30. To operate the counter balance system of the device counter balance gas line 34 is connected directly to the well head 30. Gas from this line 34 flows through counter balance check valve 35 through counter balance pressure regulator 36 into counter balance volume tank 37. This tank 37 is connected directly to counter balance cylinder bottom 15 by means of a counter balance pressure line 38. Counter balance pressure regulator 36 is adjusted to admit sufficient pressure to counter balance volume tank 37 to overcome the weight of the well sucker rod 39 plus one-half of the weight of the fluid load being pumped.

The control system 40 of the device of this invention includes a floating piston five-way valve 41 illustrated principally in FIGS. 7 and 8 and snifter valve 44 as illustrated in FIG. 2. For an illustration of the positioning of these components your attention is particularly invited to FIGS. 1 and 6. Top snifter valve 43 is positioned on counter balance cylinder head top 18 whereas the bottom snifter valve 44 is positioned on the pumping cylinder head bottom 21. Operably interconnecting the top snifter valve 43 and the floating piston five way valve 41 is top control line 45. In a similar fashion bottom snifter valve 44 is interconnected to the opposite end of the floating piston five-way valve 41 by means of bottom control line 46. This interconnection and interoperability of the top snifter valve 43, bottom snifter valve 44, and the floating piston five-way valve 41 alternately applies pressure to opposite sides of the power piston 24 causing the power piston 24 to reciprocate along its axis.

The configuration of the snifter valve employed in the preferred embodiment is as illustrated in FIG. 2. This component of the device employs an elongated body having a snifter cylinder 47 into which is mounted snifter piston 48. Projecting along the axis of the device is a snifter rod 49 to which the various components of snifter valve 44 are operably secured. Snifter pressure line 50 to load snifter piston 48 in the closed position may employ any external source of gas under pressure. In the particular configuration of this device snifter pressure line 50 might very well be connected directly to counter balance volume tank 37. The snifter valves 43 and 44 preferably include a brake structure 51 which comprises a brake disc 52 slidably mounted on snifter rod 49. Brake disc 52 is positioned above disc seat 53 and retained in this position by brake yoke 54. This device operates most satisfactorily with a small perforation of brake disc 52 which constitutes a brake vent 55. The purpose of the snifter valves 43 and 44 is to alternately vent floating piston five way valve 41. To accomplish this function of venting the pressure from top control line 45 and bottom control line 46 a sealing disc 56 is mounted around snifter rod 49 adjacent to which is mounted a shock absorbing washer 57 and a retaining collar 58. This structure causes sealing disc 56 to project into bleeder vent 60 in the closed position, the sealing disc 56 is moved along its axis to open bleeder vent 60 when snifter rod 49 is contacted by a piston urging it downward in the illustration of FIG. 2.

For a summary illustration of the configuration and construction of the floating piston five-way valve reference is particularly made to FIGS. 7, 8 and 9. The floating piston five-way valve 41 comprises a valve housing 66 into which is constructed an internal passage 67 which permits the constant pressure of gas to be applied to each end of floating piston 68. This loads the floating piston 68 causing it to move when pressure is released from either end of the floating piston 68. To selectively move the gas through the floating piston five-way valve 41 piston grooves 69 are constructed in the outer surface of floating piston 68. Mounted in the valve housing 66 around floating piston 68 are various housing seals 70 isolating the piston grooves 69 in a particular area of operation. This five-way valve is constructed with a top bleeder vent 71 and a bottom bleeder vent 72 which are interconnected to top snifter valve 43 and the bottom snifter valve 44, thereby controlling the movement of floating piston 68. For a description of operation of this system reference is made to FIGS. 1 and 6 in conjunction with schematic illustrations FIG. 3 and FIG. 4. The schematic illustration of floating piston five-way valve 41 of FIG. 1 and FIG. 6 are somewhat misleading in that this type valve is preferably mounted with the floating piston 68 in the horizontal position. The schematic illustration of FIG. 1 and FIG. 6 are correct insofar as the flow of gas and pressures are concerned. Cylinder top port 73 of the floating piston five-way valve 41 is interconnected to pumping cylinder top 11 through power cylinder top line 78. In a similar fashion cylinder bottom port 74 of the floating piston five-way valve 41 is connected to the pumping cylinder bottom 12 by means of a power cylinder bottom line 79. High pressure gas received directly from the well head 30 is connected to gas inlet port 75 of the floating piston five-way valve 41 by well head power line 83. Gas being exhausted from the power cylinder is exhausted from the gas exhaust top port 76 and the gas exhaust bottom port 77 into the exhaust manifold 84.

It appears quite obvious that a differential pressure would be required to exist between well head power line 83 and gas delivery line 82. This is accomplished by positioning well head gas delivery pressure regulator 80 between well head gas flow line 81 connected directly to well head 30 and the gas delivery line 82. To collect the gas exhausted from the system, exhaust manifold 84 is connected to gas exhaust top port 76 and gas exhaust bottom port 77 of the floating piston five-way valve 41. The gas from exhaust manifold 84 leads through exhaust line 85 into the gas delivery line 82.

Although the structural components of the device of this invention are described in applicant's previous patents, the particular arrangement of the various components and the interconnections of the various elements in the configuration of this device particularly adapt it to be powered by the pressure of well head gases driving the system and exhausting and recovering the gases into gas delivery line 82 results in a desirable and beneficial improvement. In the configuration of this invention illustrated in the preferred embodiment of this disclosure the only loss of gas is the minute quantity bled off to operate the floating piston five-way valve 41. An obvious expedient to recover this small quantity of gas would be to place a collector around the bleeder vent and collect the gas and vent it back into gas delivery line. Such a procedure would, however, require the operation of the control system by direct well head pressure. Certain desirable and beneficial results exist in operating the control system at lower pressures; accordingly, the suggestion of this invention is to utilize the reduced counter balanced pressure for operation of the control system.

OPERATION OF THE DEVICE

For a summary of the operation of the device, attention is particularly invited to FIGS. 1, 3, 4 and 6.

The device of this invention must be designed for and engineered to meet a specific pumping situation with due consideration of depths of the wells, pressure of the well head gas, and the pressure of gas delivery lines in the particular field. The device operates on a differential pressure between the well head gas and the gas delivery line. In the design of the device the diameters of the pumping cylinder 10, the counter balance cylinder 13, and the corresponding diameters of the counter balance piston 23 and the power piston 24, are selected to be compatible with the particular field conditions where they are to be utilized. The designed diameter of counter balance piston 23 and fluid pressure in counter balance tank 37 must result in a constant pressure introduced to the underside of counter balance piston 23 must result in pressure per square inch multiplied by the piston surface which equals the sucker rod weight 39, the friction of the system, and one-half of the fluid weight being lifted. Accordingly, the design of the counter balance system varies dependent on field conditions. In a similar manner the differential in pressure between gas pressure in well head 30 and the gas pressure in delivery line 82 in pounds per square inch when applied to the upper or lower surface of power piston 24 must be adequate to overcome one-half the fluid weight lifted on any particular up stroke plus the friction of the system. Thus, the differential pressure between the well head 30 and delivery line 82 drives the system. This differential of pressure is alternately applied on either the up or down stroke of the power piston 24 by the control function of the floating piston five-way valve 41. For purposes of illustration we will assume that well head pressure is 60 pounds psi and the delivery line pressure 82 is 50 pounds psi. Counter balance pressure regulator 36 in this particular situation is assumed to be set at 36 pounds psi, which, when applied to the lower surface of counter balance piston 23, is adequate to lift sucker rods 39, the associated pumping system, plus one-half of the fluid weight. To illustrate the up stroke sequence reference is made to FIG. 1. Bottom snifter valve 44 has been contacted by power piston 24 shifting snifter rod 49 and bleeding gas from bottom control lines 46 causing the floating piston 68 to move to the top of the schematic illustration of FIG. 1. This action vents the gas above power piston 24 through five-way valve 41 into manifold 84 and into the delivery line 82. Accordingly, the pressure above power piston 24 is 50 pounds psi. Instantaneously, the five-way valve interconnects the gas inlet port 75 and cylinder bottom port 74 which admits direct pressure of the gas from well head 30 at 60 pounds psi into pumping cylinder 10 below power piston 24 moving the system up as schematically illustrated in FIG. 1. In regard to the down stroke operation, attention is invited to FIG. 6. In this schematic illustration the counter balance piston 23 has arrived at the top of its stroke, striking snifter rod 49 of the top snifter valve 43 venting top control line 45. This causes floating piston 68 to move down in the schematic illustration of FIG. 6. This interconnects pumping cylinder bottom 12 through cylinder bottom port 74 and through gas exhaust bottom port 77 to manifold 84 and the delivery line 82. Simultaneously with this drop in pressure to 50 pounds psi below power piston 24, 60 pounds psi is applied from well head 30 through well head power line 83 and five-way valve 41 through power cylinder top line 78 to the top of power piston 24. This 10 pounds difference in pressure above and below power piston 24 causes the piston 24 carrying axial piston rod 22 to move downward. Accordingly, the system operates substantially as indicated in FIG. 1 and FIG. 6 with the gas flowing as indicated by flow lines adjacent the various conduits.

Having described the structure of the various components of the device of this invention and its operation, what is desired to be claimed is all modifications not departing from the equivalence of the components of the invention as defined in the appended claims.

I claim:

1. An improved actuator for oil well pumps particularly adapted for operation by well head gas comprising:

a. an elongated, cylindrical pumping cylinder having a central axis, b. a power piston movably positioned in said pumping cylinder dividing said pumping cylinder into a pumping cylinder top and a pumping cylinder bottom, c. an elongated, cylindrical counter balance cylinder secured in prolongation of said pumping cylinder and having a common central axis with said pumping cylinder, d. a counter balance piston movably mounted in said counter balance cylinder dividing said counter balance cylinder into a counter balance cylinder top and a counter balance cylinder bottom, e. an axial piston rod interconnecting said power piston and said counter balance piston, f. a floating piston five-way valve having a cylinder top port, a cylinder bottom port, a gas inlet port, a gas exhaust top port, and a gas exhaust bottom port, g. a bottom snifter valve operably secured to said pumping cylinder bottom, h. a power cylinder bottom line interconnecting the said cylinder bottom port and said bottom snifter valve, said power cylinder bottom line adapted to flow gases to and from said bottom snifter valve into said power cylinder bottom, i. a power cylinder top line interconnecting said cylinder top port of said five-way valve and the power cylinder top permitting the flow of gas to and from said power cylinder top, j. a top snifter valve operably mounted in said top of said counter balance cylinder, k. a top control line operably interconnecting said top snifter valve and a first end of said floating piston five-way valve, l. a bottom control line operably interconnecting said bottom snifter valve and a second end of said floating piston five-way valve, m. said top snifter valve and said bottom snifter valve in conjunction with said top and said bottom control lines and said floating piston five-way valve controlling the flow of gas to and from said power cylinder top and said power cylinder bottom, n. a counter balance volume tank containing gas under pressure, o. a counter balance pressure line interconnecting said counter balance volume tank and said bottom of said counter balance cylinder.

p. a well head gas power line adapted to receive gas under pressure from a well head connected to the said inlet port of said floating piston five-way valve, q. an exhaust manifold connected to said gas exhaust top port and said gas exhaust bottom port, r. an exhaust line leading from said exhaust manifold to, s. a gas delivery line, t. a well head gas flow line adapted to receive well head gas under pressure from a well head leading from said well head gas power line, and u. a well head gas delivery pressure regulator positioned between said well head gas flow line and said gas delivery line adapted to maintain a differential pressure between the said flow line and the said delivery line.

2. The invention of claim 1 further comprising:

a. a counter balance gas line adapted to receive well head gas under pressure from, b. a well head, c. a check valve positioned in said counter balance gas line between said well head and said counter balance volume tank passing gas under pressure to said volume tank from said well head, d. a pressure regulator operably positioned in said counter balance gas line regulating the pressure of gas admitted to said counter balance volume tank.

3. The invention of claim 1 further comprising a well head mounting means securing said pumping cylinder and said counter balance cylinder above said well head.

4. An improved actuator for oil well pumps particularly adapted for operation by well head gas comprising:

a. an elongated, cylindrical pumping cylinder having a central axis, b. a power piston movably positioned in said pumping cylinder dividing said pumping cylinder into a pumping cylinder top and a pumping cylinder bottom, c. an elongated, cylindrical counter balance secured in prolongation of said pumping cylinder and having a common central axis with said pumping cylinder, d. a counter balance piston movably mounted in said counter balance cylinder dividing said counter balance cylinder into a counter balance cylinder top and a counter balance cylinder bottom, e. an axial piston rod interconnecting said power piston and said counter balance piston, f. a floating piston five-way valve having a cylinder top port, a cylinder bottom port, a gas inlet port, a gas exhaust top port, and a gas exhaust bottom port, g. a bottom snifter valve operably secured to said pumping cylinder, h. a power cylinder bottom line interconnecting the said cylinder bottom port and said bottom snifter valve, said power cylinder bottom line adapted to flow gases to and from said power cylinder bottom, i. a power cylinder top line interconnecting said cylinder top port of said five-way valve and the power cylinder top permitting the flow of gas to and from said power cylinder top, j. a top snifter valve operably secured to said counter balance cylinder, k. a top control line operably interconnecting said top snifter valve and a first end of said floating piston five-way valve, l. a bottom control line operably interconnecting said bottom snifter valve and a second end of said floating piston five-way valve, m. said top snifter valve and said bottom snifter valve in conjunction with said top and said bottom control lines and said floating piston five-way valve controlling the flow of gas to and from said power cylinder top and said power cylinder bottom, n. a counter balance volume tank containing gas under pressure, o. a counter balance pressure line interconnecting said counter balance volume tank and said bottom of said counter balance cylinder, p. a well head gas power line adapted to receive gas under pressure from a well head connected to the said inlet port of said floating piston five-way valve, q. an exhaust manifold connected to said gas exhaust top port and said gas exhaust bottom port, r. an exhaust line leading from said exhaust manifold to, s. a gas delivery line, t. a well head gas flow line adapted to receive well head gas under pressure from a well head leading from said well head gas power line, and u. a well head gas delivery pressure regulator positioned between said well head gas flow line and said gas delivery line adapted to maintain a differential pressure between the said flow line and the said delivery line.

5. The invention of claim 4 further comprising:

a. a counter balance gas line adapted to receive well head gas under pressure from, b. a well head, c. a check valve positioned in said counter balance gas line between said well head and said counter balance volume tank passing gas under pressure to said volume tank from said well head, d. a pressure regulator operably positioned in said counter balance gas line regulating the pressure of gas admitted to said counter balance volume tank.

6. The invention of claim 4 further comprising a well head mounting means securing said pumping cylnder and said counter balance cylinder above said well head.

* * * * *